US009212593B2

(12) United States Patent
An et al.

(10) Patent No.: US 9,212,593 B2
(45) Date of Patent: Dec. 15, 2015

(54) STRUCTURE OF DUAL EXHAUST SYSTEM FOR CDA ENGINE

(71) Applicant: Hyundai Motor Company, Seoul (KR)

(72) Inventors: Ho-Chan An, Hwasung-shi (KR); Chul-Min Park, Seoul (KR); Seung-Hwan Lim, Seoul (KR); Jong-Ho Seon, Inchun-shi (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/522,353

(22) Filed: Oct. 23, 2014

(65) Prior Publication Data

US 2015/0136520 A1 May 21, 2015

(30) Foreign Application Priority Data

Nov. 15, 2013 (KR) ..... 10-2013-0138759

(51) Int. Cl.

| | |
|---|---|
| ***F01N 13/04*** | (2010.01) |
| ***F01N 13/00*** | (2010.01) |
| ***F01N 13/02*** | (2010.01) |
| ***F01N 1/02*** | (2006.01) |
| ***F01N 1/16*** | (2006.01) |

(52) U.S. Cl.

CPC ..... *F01N 13/0093* (2014.06); *F01N 1/02* (2013.01); *F01N 1/163* (2013.01); *F01N 13/02* (2013.01); *F01N 13/04* (2013.01)

(58) Field of Classification Search

CPC ..... F01N 1/163; F01N 13/02; F01N 13/04; F01N 13/11

USPC ..... 181/232, 237, 238, 254; 60/313, 323

See application file for complete search history.

(56) References Cited

U.S. PATENT DOCUMENTS

| | | | | |
|---|---|---|---|---|
| 3,653,212 | A * | 4/1972 | Gast et al. | 60/293 |
| 3,943,710 | A * | 3/1976 | Lange | 60/288 |
| 4,408,675 | A * | 10/1983 | Keller | 180/296 |
| 4,926,634 | A * | 5/1990 | Putz et al. | 60/274 |
| 4,926,636 | A * | 5/1990 | Tadokoro et al. | 60/312 |
| 5,014,817 | A * | 5/1991 | Takato et al. | 181/254 |
| 5,647,207 | A * | 7/1997 | Grotjahn et al. | 60/300 |
| 6,454,047 | B1 * | 9/2002 | Galaitsis | 181/254 |
| 6,557,341 | B2 * | 5/2003 | Bubeck et al. | 60/284 |
| 6,662,554 | B2 * | 12/2003 | Sheidler et al. | 60/290 |
| 7,090,048 | B2 * | 8/2006 | Albertson et al. | 181/240 |

(Continued)

FOREIGN PATENT DOCUMENTS

| | | |
|---|---|---|
| JP | 2000-179367 A | 6/2000 |
| JP | 2005-325747 A | 11/2005 |

*Primary Examiner* — Jeremy Luks

(74) *Attorney, Agent, or Firm* — Morgan, Lewis & Bockius LLP

(57) ABSTRACT

A structure of a dual exhaust system for a cylinder deactivation (CDA) engine, may include two inlet pipes, two outlet pipes, each of which protrudes and extends from an inside of a corresponding main muffler to an outside of the corresponding main muffler, wherein each of the two outlet pipes releases the exhaust gas passing through the corresponding main muffler to an outside of the vehicle therethrough, a connecting pipe disposed in a vehicle width direction and connecting between the two main mufflers, and a valve mounted on one outlet pipe of the two outlet pipes to open and close the one outlet pipe, wherein when the valve may be closed, the exhaust gas passing through one of the main mufflers may be introduced into the other main muffler of the two outlet pipes through the connecting pipe and then may be emitted to the outside of the vehicle.

6 Claims, 5 Drawing Sheets

(56) References Cited

U.S. PATENT DOCUMENTS

| | | | | |
|---|---|---|---|---|
| 7,347,045 | B2 * | 3/2008 | Bozmoski et al. | 60/312 |
| 7,377,359 | B2 * | 5/2008 | Hofmann et al. | 181/275 |
| 7,650,965 | B2 * | 1/2010 | Thayer et al. | 181/232 |
| 7,703,574 | B2 * | 4/2010 | Kruger et al. | 181/254 |
| 7,849,959 | B2 * | 12/2010 | Amir et al. | 181/228 |
| 8,365,522 | B2 * | 2/2013 | Abram et al. | 60/324 |
| 8,826,651 | B2 * | 9/2014 | Laube et al. | 60/299 |
| 2004/0194456 | A1 * | 10/2004 | Kim | 60/323 |
| 2006/0000667 | A1 * | 1/2006 | Osterkamp et al. | 181/249 |
| 2007/0272479 | A1 * | 11/2007 | Mirlach et al. | 181/253 |
| 2009/0020359 | A1 * | 1/2009 | Schorn et al. | 181/228 |
| 2010/0192558 | A1 * | 8/2010 | Matsueda | 60/322 |

* cited by examiner

STRUCTURE OF DUAL EXHAUST SYSTEM FOR CDA ENGINE

CROSS-REFERENCE TO RELATED APPLICATIONS

The present application claims priority to Korean Patent Application No. 10-2013-138759, filed on Nov. 15, 2013, the entire contents of which is incorporated herein for all purposes by this reference.

BACKGROUND OF THE INVENTION

1. Field of the Invention

The present invention relates to a structure of an exhaust system for a vehicle, and more particularly, to a structure of a dual exhaust system for a CDA engine capable of reducing low frequency noise by avoiding an outlet pipe resonance at the time of a CDA mode by connecting between two main mufflers through a connecting pipe and equipping a valve in one of the outlet pipes to open and close the one outlet pipe.

2. Description of Related Art

Recently, as environmental issues are increased, an environmental problem due to an excessive emission of exhaust gas of a vehicle has emerged and consumers are highly likely to prefer a high fuel efficiency vehicle due to the rise in oil prices. Therefore, various technologies for improving fuel efficiency of a vehicle and an engine output have been developed.

Various technologies, such as a variable induction system (VIS) which changes a length or a cross sectional area of an intake manifold in response to an air suction resistance changed depending on a rotating region of an engine, a variable valve timing (VVT) which controls an opening and closing timing and a lift of a valve depending on a rotating area of an engine, a variable valve lift (VVL) which controls a lifting height of a valve, and a cylinder deactivation (CDA) which converts a part of engine cylinders into a non-operation/full operation depending on a driving condition for the purpose of improving fuel efficiency, have been developed and applied to a vehicle.

Among those technologies, the CDA engine device an engine which deactivates some of all the cylinders at the time of braking or cruise and an operation of a fuel supply and intake/exhaust valve stops at a deactivated cylinder side.

A maximum output of a vehicle engine is required only when a vehicle is accelerated or goes up a ramp. Therefore, when the vehicle is driven even by a partial output of the engine, all the cylinders are not necessarily ignited, and as a result, fuel may be saved.

For example, in the case of a vehicle in which a six-cylindered engine is equipped, there is no need to generate power by operating all the cylinders in a braking or low idle condition or a low load condition while in the driving state. Therefore, power is generated by deactivating the operation of three cylinders and activating the operation of only the remaining three cylinders.

As illustrated in FIGS. 1A and 1B, a structure of a dual exhaust system for a CDA engine is a structure in which two inlet pipes 1 branched from an engine of a vehicle are connected to two main mufflers 2 and two outlet pipes 3 are connected from the two main mufflers 2.

As illustrated in FIG. 1A, when the engine of the vehicle is in a general mode, exhaust gas is emitted to both sides through the two main mufflers 2 and as illustrated in FIG. 1B, when the engine of the vehicle is in the CDA mode, the exhaust gas is emitted to only one side through one main muffler 2.

The structure of a dual exhaust system for a CDA engine according to the related art is a structure in which in the CDA mode, only one main muffler is used and the other main muffler is deactivated, and therefore has noise reduction performance which is more deteriorated than the case of using the two main mufflers.

The CDA engine consumes less fuel than a typical engine and therefore has excellent fuel efficiency, but has some of the cylinders which are not ignited, and therefore changes main components of the engine noise to increase noise in a low frequency range.

The main component of the engine noise device a value obtained by dividing an explosive number of an engine by an engine RPM, which is represented by the following Equation.

[Equation]

Main Component of Engine Noise=Explosive number of Engine/Engine RPM

That is, in the case of the vehicle in which the 6-cylindered engine is equipped, in a general mode in which all of the 6 cylinders are operated, the noise component corresponding to C3 (6/2=3) in the following Table 1 forms the main component of the engine noise and in the CDA mode in which only the three of the six cylinders are operated, the noise component corresponding to C1.5 (3/2=1.5) forms the main component of the engine noise.

TABLE 1

| | C1.5 | C3 | C4.5 | C6 |
|---|---|---|---|---|
| 1,000 rpm | 25 Hz | 50 Hz | 75 Hz | 100 Hz |
| 6,000 rpm | 150 Hz | 300 Hz | 450 Hz | 600 Hz |

Therefore, in the CDA mode in which only the three of the six cylinders are operated, the low frequency noise component (noise component corresponding to C1.5 among the main components of the engine noise) which is little generated in a general mode is additionally generated and then combined with a low frequency resonance mode of the existing outlet pipe, which may have a bad effect on the vehicle noise.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a structure of a dual exhaust system for a CDA engine capable of reducing exhaust gas noise by using all the main mufflers even at the time of a CDA mode operation and reducing noise in a low frequency range based on an effect of extending an overall length of the structure of the dual exhaust system, by connecting between two main mufflers through a connecting pipe.

In an aspect of the present invention, a structure of a dual exhaust system for a cylinder deactivation (CDA) engine, may include two inlet pipes through which exhaust gas emitted from an engine of a vehicle is introduced into two main mufflers, respectively, two outlet pipes, each of which protrudes and extends from an inside of a corresponding main muffler to an outside of the corresponding main muffler, wherein each of the two outlet pipes releases the exhaust gas passing through the corresponding main muffler to an outside of the vehicle therethrough, a connecting pipe disposed in a vehicle width direction and connecting between the two main mufflers, and a valve mounted on one outlet pipe of the two outlet pipes to open and close the one outlet pipe, wherein when the valve is closed, the exhaust gas passing through one of the main mufflers is introduced into the other main muffler of the two outlet pipes through the connecting pipe and then is emitted to the outside of the vehicle.

Two baffles mounted inside of each of the two main mufflers in a lateral direction to partition the inside of the main mufflers into a first space, a second space, and a third space respectively, wherein the connecting pipe connects between the first space of one main muffler of the two main mufflers and the first space of the other main muffler.

Each of the two outlet pipes penetrate through the first baffle and the second baffle from the first space of the corresponding main muffler to extend to the third space and then is bent to penetrate through the second baffle and the first baffle again and extends to the first space in the corresponding main muffler.

The valve is coupled with a back end portion protruding to the outside of the main muffler of the outlet pipe which is mounted in the one main muffler of the two main mufflers.

When the engine of the vehicle is in a general mode, the valve opens the one outlet pipe of the two outlet pipes, and the exhaust gas is introduced into the two main mufflers through each of the two inlet pipes and then is emitted to the outside of the vehicle through the two outlet pipes.

When the engine of the vehicle is in a cylinder deactivation (CDA) mode. the valve closes the one outlet pipe of the two outlet pipes, and the exhaust gas is introduced into one of the two main mufflers through one of the two inlet pipes and then is introduced into the other main muffler through the connecting pipe and is emitted to the outside of the vehicle through the other outlet pipe which is mounted in the other main muffler.

According to the exemplary embodiments of the present invention having the above-mentioned configuration, the structure of a dual exhaust system for a CDA engine may include the connecting pipe connecting between the two main mufflers and the valve opening and closing the one outlet pipe to use all the main mufflers which are not used at the time of the CDA mode operation in the structure of a dual exhaust system for a CDA engine according to the related art, thereby remarkably increasing the noise reduction performance of the exhaust gas.

The structure of a dual exhaust system for a CDA engine is configured so that at the time of the CDA mode operation, the exhaust gas is introduced into the other main muffler through the connecting pipe from the one main muffler and then is emitted to the outlet pipe to increase the overall length of the exhaust system in which the exhaust gas flows, thereby effectively implementing the avoidance design of the exhaust system resonance.

The structure of a dual exhaust system for a CDA engine may obtain the same effect as the configuration in which the main muffler is separately added to the position at which the main component of the engine noise corresponding to the C1.5 additionally generated at the time of the CDA mode operation may be reduced, thereby remarkably reducing the noise in the low frequency range of a vehicle.

Compared with the structure of a dual exhaust system for a CDA engine according to the related art which has a limitation in expanding the CDA mode operation range due to the noise vibration harshness (NVH) problem of the vehicle, the structure of a dual exhaust system for a CDA engine according to the exemplary embodiment of the present invention may more expand the CDA mode operation range, thereby expecting the improvement in the additional fuel efficiency of the vehicle.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1A:
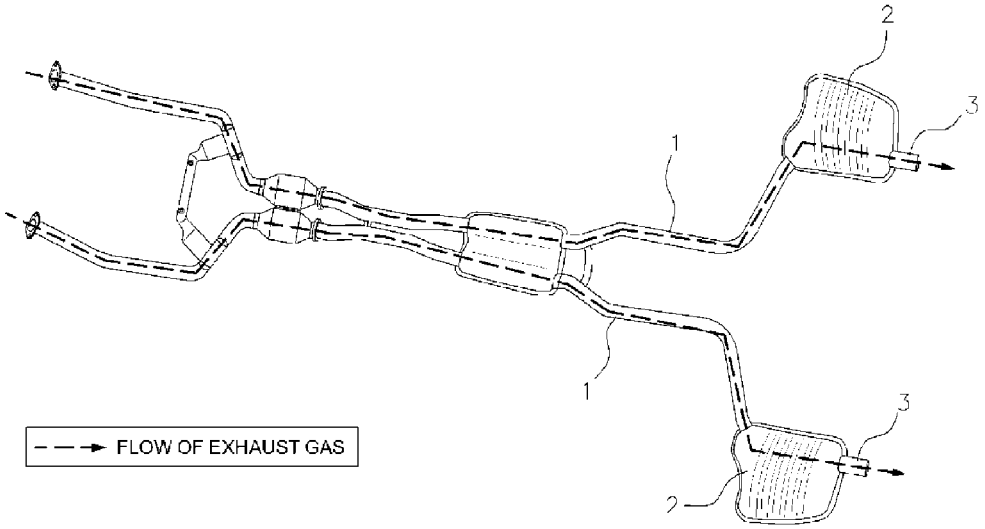
FIG. 1A (Related Art)
FIG. 1A is an exemplified view illustrating a flow of exhaust gas when an engine of a vehicle in a structure of a dual exhaust system for a CDA engine according to the related art is in a general mode.
Figure 1B:
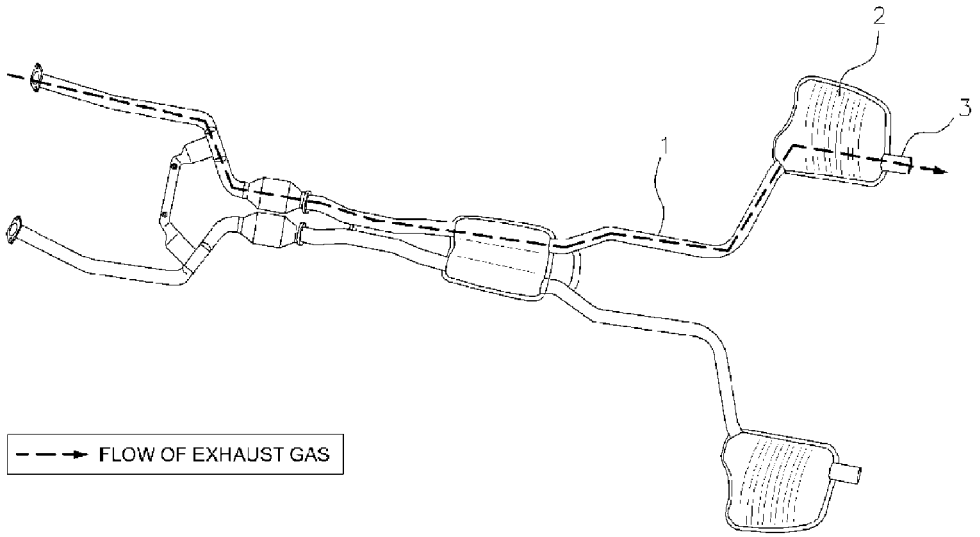
FIG. 1B (Related Art)
FIG. 1B is an exemplified view illustrating the flow of exhaust gas when the engine of the vehicle in the structure of a dual exhaust system for a CDA engine according to the related art is in a CDA mode.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, exemplary embodiments of the present invention will be described in detail with reference to the accompanying drawings.

A structure of a dual exhaust system for a cylinder deactivation (CDA) engine according to an exemplary embodiment of the present invention includes two inlet pipes through which exhaust gas emitted from an engine of a vehicle is introduced into two main mufflers, respectively, two outlet pipes which each protrude and extend from an inside of the main muffler to an outside of the main muffler and each have the exhaust gas passing through the main mufflers be emitted to an outside of the vehicle therethrough, a connecting pipe 40 which is disposed in a vehicle width direction to connect between the two main mufflers, and a valve 50 which is mounted on one of the two outlet pipes to open and close the one outlet pipe, in which when the valve 50 is closed, the exhaust gas passing through one of the main mufflers is introduced into the other main muffler through the connecting pipe 40 and then is emitted to the outside of the vehicle.

Figure 2A:
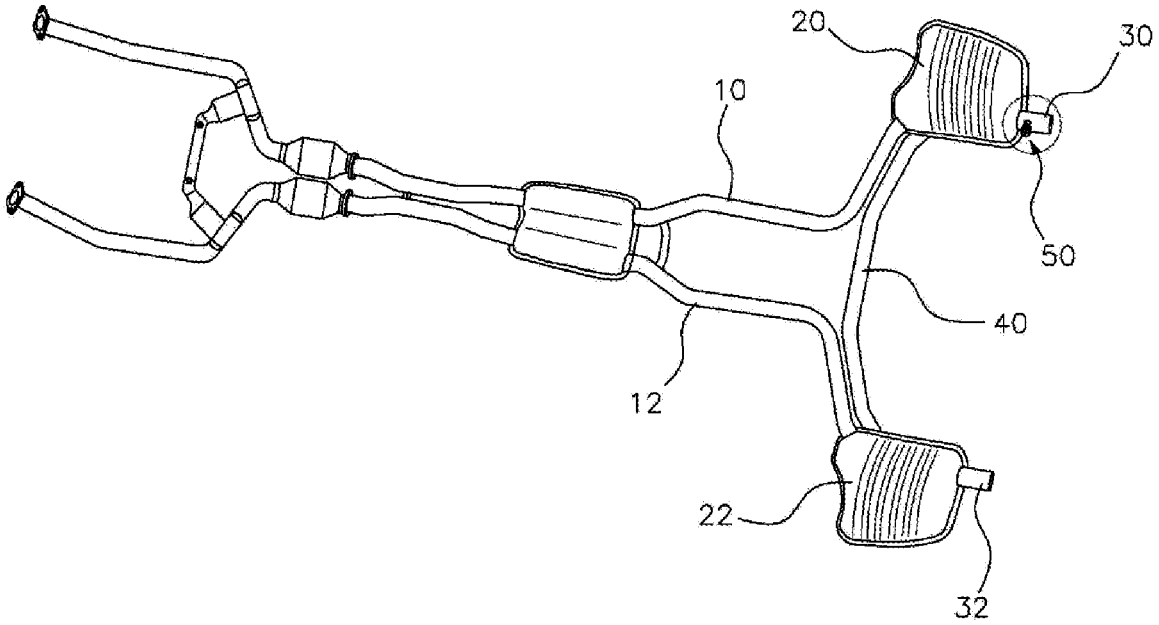
FIG. 2A and FIG. 2B are perspective views illustrating an overall appearance of a structure of a dual exhaust system for a CDA engine according to an exemplary embodiment of the present invention.
Figure 2B:
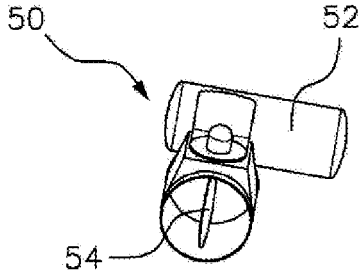

As illustrated in FIGS. 2A and 2B, the two inlet pipes are each connected to the two main mufflers to supply the exhaust gas emitted from the engine of the vehicle to the inside of the main muffler and the main muffler serves to reduce noise due to the exhaust gas.

In detail, in the illustrated exemplary embodiment, the inlet pipe is divided into a first inlet pipe 10 which is disposed at a right hand (RH) of the vehicle and a second inlet pipe 12 which is disposed at a left hand (LH) of the vehicle and in a similar manner, the main muffler is divided into a first main muffler 20 and a second main muffler 22.

Figure 4:
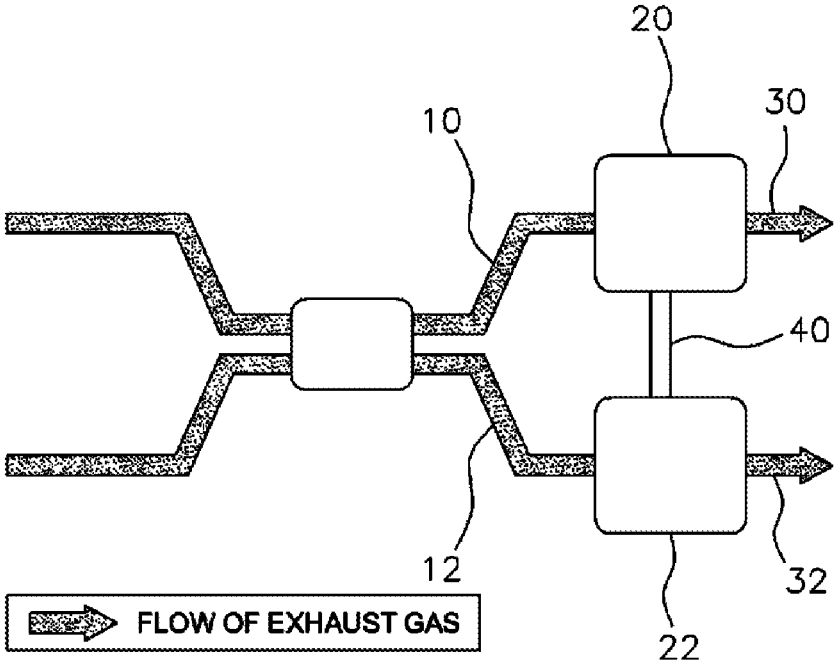
FIG. 4 is an exemplified view illustrating a flow of exhaust gas when an engine of a vehicle in the structure of a dual exhaust system for a CDA engine according to the exemplary embodiment of the present invention is in a general mode.

As illustrated in FIG. 4, in the general case, the exhaust gas flows in the first inlet pipe 10 and the second inlet pipe 12 which are each branched at a lower end of the vehicle and thus is introduced into the first main muffler 20 and the second muffler 22.

Figure 3:
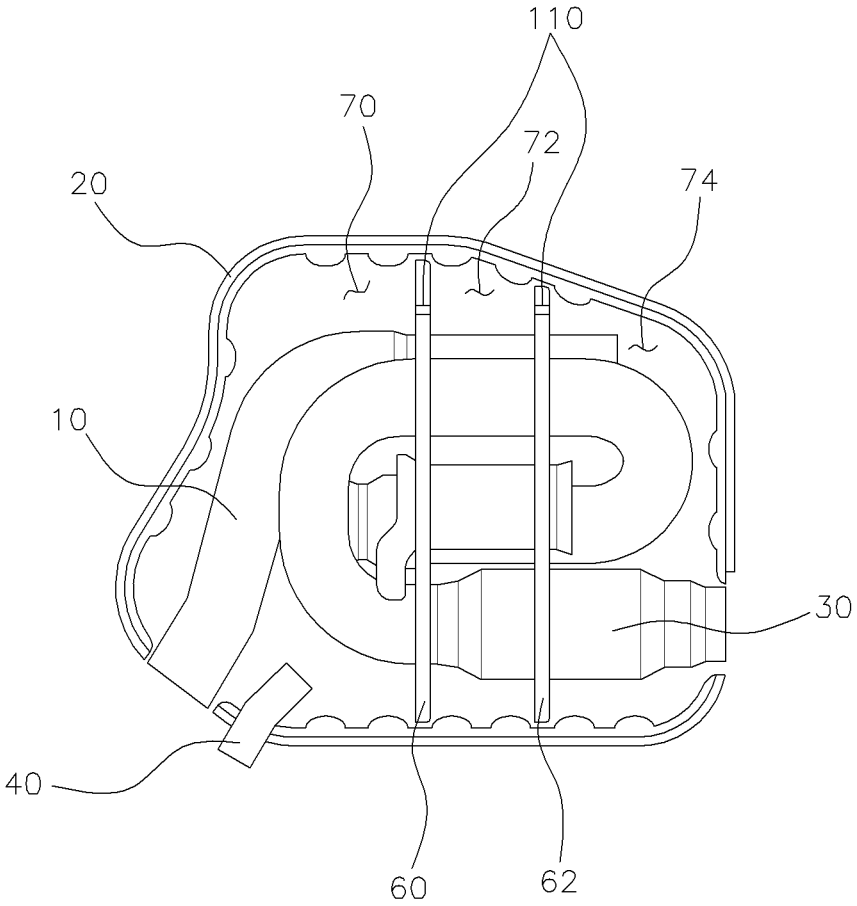
FIG. 3 is a cutting view illustrating an appearance of an inside of a main muffler according to an exemplary embodiment of the present invention.

As illustrated in FIGS. 2 and 3, the two outlet pipes each protrude from insides of the first main muffler 20 and the second main muffler 22 to back sides of the first main muffler 20 and the second main muffler 22 to serve to emit the exhaust gas passing through the main mufflers to the outside of the vehicle.

As described above, the outlet pipe is divided into a first outlet pipe 30 which is connected to the first main muffler 20 disposed at the right hand of the vehicle and a second outlet pipe 32 which is connected to the second main muffler 22 disposed at the left hand of the vehicle.

As illustrated in FIGS. 2A and 2B, the connecting pipe 40 is coupled between the first main muffler 20 and the second main muffler 22 in a vehicle width direction U shape to make the exhaust gas flow therein.

The connecting pipe 40 serves to transfer the exhaust gas introduced into the first main muffler 20 to the second main muffler 22 when the valve 50 to be described below is closed and to increase the overall length of the exhaust system.

As illustrated in FIGS. 2A and 2B, the valve 50 is mounted on the first outlet pipe 30 connected to the first main muffler 20 to serve to open or close the first outlet pipe 30 depending on whether the CDA mode is operated.

As illustrated in FIGS. 2A and 2B, the valve 50 is configured in such a manner that a motor 52 is operated by a controller depending on whether the CDA mode is operated to rotate a disk-shaped cover 54.

In detail, when the engine of the vehicle is in the general mode, the motor 52 is operated in such a manner that the cover 54 is disposed in a vertical direction to a cross section of the first outlet pipe 30 to allow the exhaust gas to pass and when the engine of the vehicle is in the CDA mode, the motor 52 is operated in such a manner that the cover 54 is disposed in a horizontal direction to the cross section of the first outlet pipe 30 so that the exhaust gas does not pass.

That is, when the valve 50 is closed, the exhaust gas introduced into the first main muffler 20 is not emitted to the first outlet pipe 30 and flows in the second main muffler 22 through the connecting pipe 40 and then is emitted to the outside of the vehicle through the second outlet pipe 32.

As illustrated in FIG. 3, the inside of the first main muffler 20 is preferably coupled with two baffles in a lateral direction to partition the inside of the first main muffler 20 into a first space 70 to a third space 74.

In detail, in the illustrated exemplary embodiment, a space which is positioned at a most front side of the first main muffler 20 is the first space 70, a space positioned just after the first space 70 is the second space 72, and a space which is positioned at a most back side of the first main muffler 20 is the third space 74.

In the illustrated exemplary embodiment, the baffle is divided into a first baffle 60 which is disposed between the first space 70 and the second space 72 and a second baffle 62 which is disposed between the second space 72 and the third space 74.

The first baffle 60 and the second baffle may be provided with punched holes 110, a plurality of holes, a plurality of short 62 pipes, a permeable plate membrane, or the like to make the exhaust gas freely move.

As illustrated in FIGS. 2 and 3, the first inlet pipe 10 may penetrate through the first main muffler 20 from the engine of the vehicle and then penetrate through the first baffle 60 and the second baffle 62 to extend to the third space 74 inside the first main muffler 20.

The first outlet pipe 30 may penetrate through the first baffle 60 and the second baffle 62 from the first space 70 of the first main muffler 20 to extend to the third space 74 and then may be bent in a 'U'-letter shape to penetrate through the second baffle 62 and the first baffle 60 again and extend to the first space 70, and may be bent in a 'U'-letter shape again to penetrate through the first baffle 60 and the second baffle 62 and then protrude and extend to the outside of the first main muffler 20.

Although not illustrated, the inside of the second main muffler 22 is coupled with the first baffle 60 and the second baffle 62 in a similar manner to partition the inside of the second main muffler 22 into the first space 70 to the third space 74 and is connected to the second inlet pipe 12 and the second outlet pipe 32 in a similar manner.

As illustrated in FIGS. 2 and 3, the connection pipe 40 is disposed to connect between the first space 70 of the first main muffler 20 and the first space 70 of the second main muffler 22.

That is, when the engine of the vehicle is in the CDA mode, the exhaust gas introduced into the third space 74 of the first main muffler 20 flows in the first space 70 through the punched holes, and the like which are formed in the first baffle 60 and the second baffle 62 and flows in the first space 70 of the second main muffler 22 through the connecting pipe 40 connected to the first space 70 of the first main muffler 20 to be emitted to the outside of the vehicle through the second outlet pipe 32.

As described above, the connecting pipe 40 is connected to the first space 70 of the first main muffler 20 to completely use the first main muffler 20, thereby maximizing the noise reduction performance of the exhaust gas.

As illustrated in FIGS. 2A and 2B, the valve 50 may be coupled with a portion protruding to the outside of the first main muffler 20 of the first outlet pipe 30 which is connected to the first main muffler 20, that is, a back end portion.

The valve 50 may be coupled with any position on the first outlet pipe 30 when the valve 50 is present at a position at which the first outlet pipe 30 may be opened and closed, but the valve 50 is coupled with the back end portion as described above such that an assembly worker of the structure of the dual exhaust system may simply add only the valve 50 while using the main muffler according to the related art as it is.

That is, the assembly worker may achieve an effect of the structure of a dual exhaust system for a CDA engine according to the exemplary embodiment of the present invention using the relatively simple assembling process of connecting between the first main muffler 20 and the second main muffler 22 by the connecting pipe 40, coupling the valve 50 with the back end of the first outlet pipe 30, and the like, thereby reducing the assembling process and the assembling time and reducing the man hour.

Those skilled in the art may appreciate that the valve 50 is coupled with the back end of the second outlet pipe 32 when the exhaust gas of the vehicle is supplied only through the second inlet pipe 12 when the CDA mode is operated depending on a kind of vehicle, unlike the present invention.

The operation process and action effects of the structure of a dual exhaust system for a CDA engine according to the exemplary embodiment of the present invention will be described below.

As illustrated in FIGS. 3 and 4, when the CDA mode is not operated, that is, when the engine of the vehicle is in the general mode, the exhaust gas is supplied to the third space 74 of the first main muffler 20 through the first inlet pipe 10.

The exhaust gas supplied to the third space 74 flows in the first space 70 through the punched holes, and the like which are formed in the first baffle 60 and the second baffle 62 and is emitted to the outside of the vehicle through the first outlet pipe 30 which is opened.

In a similar manner, the exhaust gas supplied to the inside of the second main muffler 22 through the second inlet pipe 12 passes through the first space 70 to the third space 74 inside the second main muffler 22 and then is emitted to the outside of the vehicle through the second outlet pipe 32.

Figure 5:
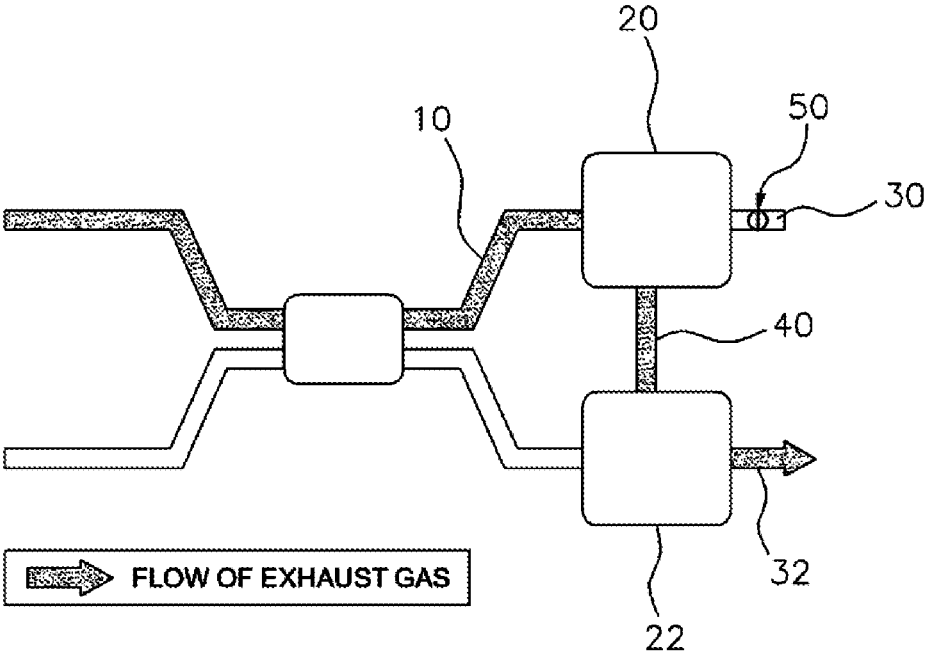
FIG. 5 is an exemplified view illustrating the flow of exhaust gas when the engine of the vehicle in the structure of a dual exhaust system for a CDA engine according to the exemplary embodiment of the present invention is in a CDA mode.

As illustrated in FIGS. 3 and 5, when the engine of the vehicle is in the CDA mode, similarly, the exhaust gas is supplied to the third space 74 of the first main muffler 20 through the first inlet pipe 10.

The exhaust gas supplied to the third space 74 flows in the first space 70 through the punched holes which are formed in the first baffle 60 and the second baffle 62, but since the first outlet pipe 30 is closed by the valve 50, the exhaust gas is not emitted to the first outlet pipe 30 and is supplied to the first space 70 of the second main muffler 22 through the connecting pipe 40.

The exhaust gas supplied to the first space 70 of the second main muffler 22 is introduced into the inlet of the second outlet pipe 32 which is opened and thus is emitted to the outside of the vehicle through the second outlet pipe 32.

As described above, when the engine of the vehicle is in the CDA mode, the noise component corresponding to the C1.5 among the main components of the engine noise is additionally generated and thus is coupled with the low frequency resonance mode of the outlet pipe, which is a cause of aggravating the noise of the vehicle.

Figure 6:
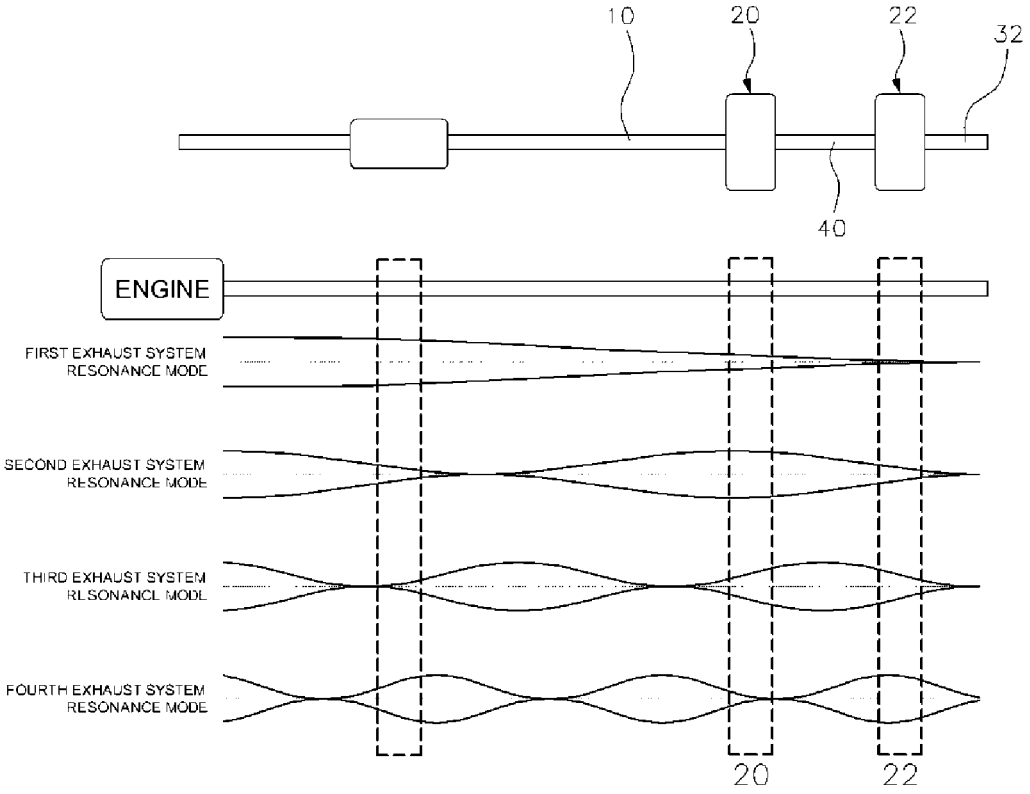
FIG. 6 is an exemplified view schematically illustrating an exhaust system resonance mode and a position of a muffler when the engine of the vehicle in the structure of a dual exhaust system for a CDA engine according to the exemplary embodiment of the present invention is in the CDA mode.

Therefore, as illustrated in FIG. 6, the structure of a dual exhaust system for a CDA engine according to the exemplary embodiment of the present invention obtains the same effect as separately adding one second main muffler 22 at the time of the CDA mode operation, thereby remarkably reducing the noise of the vehicle due to the low frequency resonance mode.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A structure of a dual exhaust system for a cylinder deactivation (CDA) engine, comprising:

two inlet pipes through which exhaust gas emitted from an engine of a vehicle is introduced into two main mufflers, respectively;

two outlet pipes, each of which protrudes and extends from an inside of a corresponding main muffler to an outside of the corresponding main muffler, wherein each of the two outlet pipes releases the exhaust gas passing through the corresponding main muffler to an outside of the vehicle therethrough;

a connecting pipe disposed in a vehicle width direction and connecting between the two main mufflers; and a valve mounted on one outlet pipe of the two outlet pipes to open and close the one outlet pipe, wherein when the valve is closed, the exhaust gas passing through one of the main mufflers is introduced into the other main muffler of the two outlet pipes through the connecting pipe and then is emitted to the outside of the vehicle.

2. The structure of claim 1, further comprising:

two baffles mounted inside of each of the two main mufflers in a lateral direction to partition the inside of the main mufflers into a first space, a second space, and a third space respectively, wherein the connecting pipe connects between the first space of one main muffler of the two main mufflers and the first space of the other main muffler.

3. The structure of claim 2, wherein each of the two outlet pipes penetrate through the first baffle and the second baffle from the first space of the corresponding main muffler to extend to the third space and then is bent to penetrate through the second baffle and the first baffle again and extends to the first space in the corresponding main muffler.

4. The structure of claim 1, wherein the valve is coupled with a back end portion protruding to the outside of the main muffler of the outlet pipe which is mounted in the one main muffler of the two main mufflers.

5. The structure of claim 1, wherein when the engine of the vehicle is in a general mode, the valve opens the one outlet pipe of the two outlet pipes, and the exhaust gas is introduced into the two main mufflers through each of the two inlet pipes and then is emitted to the outside of the vehicle through the two outlet pipes.

6. The structure of claim 1, wherein when the engine of the vehicle is in a cylinder deactivation (CDA) mode, the valve closes the one outlet pipe of the two outlet pipes, and the exhaust gas is introduced into one of the two main mufflers through one of the two inlet pipes and then is introduced into the other main muffler through the connecting pipe and is emitted to the outside of the vehicle through the other outlet pipe which is mounted in the other main muffler.

* * * * *